US005674065A

United States Patent [19]

Grando et al.

[11] Patent Number: 5,674,065

[45] Date of Patent: Oct. 7, 1997

[54] APPARATUS FOR CONTROLLING THE SUPPLY OF GAS TO AND HEAT FROM UNVENTED GAS HEATING APPLIANCES

[75] Inventors: Maurizio Grando, Chirignago; Michele Bortoliero, Monselice, both of Italy; Kenneth D. Fox, Charlotte, N.C.

[73] Assignee: Op S.R.L., Pernumi, Italy

[21] Appl. No.: 589,501

[22] Filed: Jan. 22, 1996

[51] Int. Cl.[6] ..... F23Q 9/08

[52] U.S. Cl. ..... 431/54; 431/53; 126/512

[58] Field of Search ..... 431/51, 53, 54; 126/512

[56] References Cited

U.S. PATENT DOCUMENTS 4,285,662 8/1981 Katchka et al. ..... 431/53

5,397,233 3/1995 Eavenson et al. ..... 26/12

*Primary Examiner*—Carroll B. Dority

*Attorney, Agent, or Firm*—Sughrue, Mion, Zinn, Macpeak & Seas

[57] ABSTRACT

This invention relates to the operation of unvented gas fired appliances and enhances the safety of effectively controlling the flow of gases to an unvented gas heater, such as gas fired fireplace logs, while enabling a thermostat to control the temperature of the heated area by combining a thermocouple for safety and a thermopile for operation of the thermostat.

6 Claims, 2 Drawing Sheets

APPARATUS FOR CONTROLLING THE SUPPLY OF GAS TO AND HEAT FROM UNVENTED GAS HEATING APPLIANCES

FIELD OF THE INVENTION

This invention relates to the control of combustible gases delivered to unvented gas appliances and the heat provided by them, for example space heaters, gas fireplaces, and log sets.

BACKGROUND OF THE INVENTION

Use of natural gas and liquified petroleum gas in unvented appliances, such as gas fired fireplace logs and space heaters has become popular because of the cleanliness of the gas and the development of precision pilot burners for controlling safety devices which shut off gas to the heater.

Safety devices that are currently in common use include a sealed pilot flame integrated with an oxygen depletion sensor (ODS). Another device that is currently in common use is a thermal responsive electrical generator, known in the trade as a thermocouple, that is normally heated by the pilot flame to generate a sufficient amount of electrical energy to open an electromagnetic valve in the incoming gas supply line to permit the flow of gas to the pilot and main burner. When the pilot flame goes out and the thermocouple cools the electromagnetic valve closes and shuts off all flow of gas.

Another device in common use is the thermopile, which is a thermal responsive electrical generator that is heated by the pilot flame to generate a sufficient amount of electrical energy to operate an electromagnetic valve that controls the flow of gas to the main burner and to also operate a thermostat that controls the temperature of the heated area by successively activating and deactivating the valve controlling the flow of gas to the main burner.

Most gas fired fireplace logs in use today employ a thermocouple to shut off the flow of gas to the pilot and to the main burner if the pilot flame goes out. The burner in such gas fired fireplace logs is not controlled by a thermostat because the thermocouple is a device used to supply operating voltage for only a single electromagnetic valve, known as a safety shut off device.

U.S. Pat. No. 5,397,233 issued Mar. 14, 1995 to Eavenson, et al. for ASSEMBLY FOR CONTROLLING THE FLOW OF GAS FOR GAS FIRED ARTIFICIAL LOGS shows a main gas burner, a pilot including an oxygen depletion sensor, and a fully automatic gas valve that controls the flow of gas to the pilot and to the main burner. Eavenson et al. teaches that the flow of gas to gas fired fireplace logs can be safely and effectively controlled by a thermostat without using a thermocouple. Eavenson uses a thermopile having an output voltage of at least 250 millivolts that is operatively connected to the gas valve and to the thermostat if the thermopile is spaced at least half an inch from the pilot and its oxygen depletion sensor.

Eavenson's omission of a thermocouple sacrifices the safety provided by the intentionally low voltage of the thermocouple. The thermocouple is instantly responsive to the ODS, whereas a period of time is required for the thermopile to sufficiently cool to close the valve and interrupt the flow of gas.

SUMMARY OF THE INVENTION

This invention enhances the safety of effectively controlling the flow of gases to an unvented gas heater, such as gas fired fireplace logs, while enabling a thermostat to control the temperature of the heated area. The thermocouple functions to shut off the gas when the pilot flame goes out, and the function of the thermopile is to operate the thermostat to have a desired room temperature provided by the gas fired burner.

Specifically, the invention is the combination of a thermocouple and a thermopile operatively positioned relative to a pilot integrated with an oxygen depletion sensor. The thermocouple is electrically connected to an electromagnetic valve that controls the flow of gas from the supply source to the pilot and to the main burner. The thermopile is electrically connected to a thermostat that is electrically connected to an electromagnetic valve that controls the flow of gas to the main burner.

DETAILED DESCRIPTION OF THE INVENTION

Figure 1:
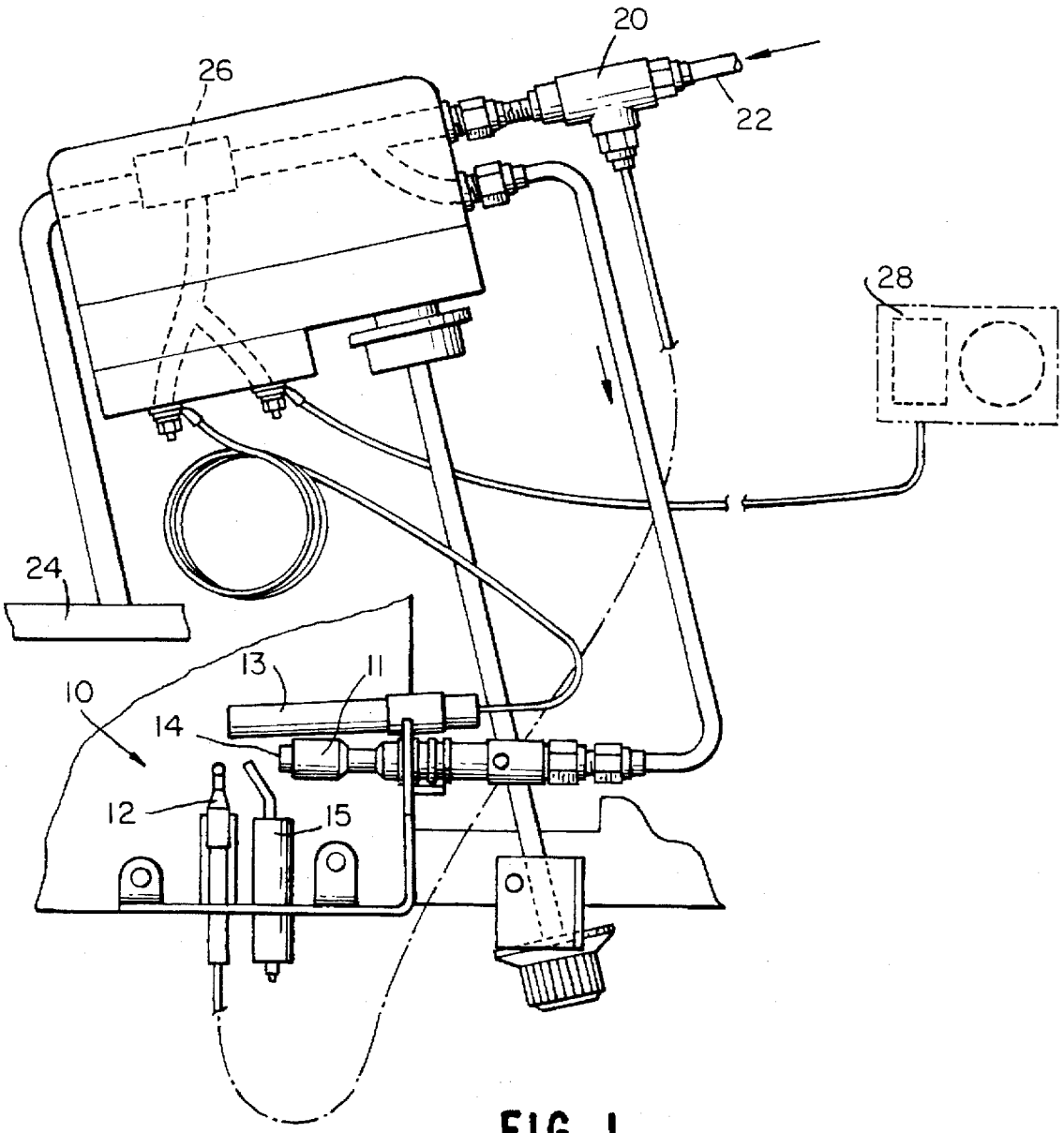
FIG. 1 is a schematic view of the gas and heat control apparatus.

Referring more specifically to the drawings, FIG. 1 illustrates the control apparatus for natural gas in association with gas fired logs, generally indicated at 10. The control apparatus comprises a sealed pilot 11, a thermocouple 12, and a thermopile 13.

The sensing portion of a conventional oxygen depletion safety device (ODS, not shown) is integrated with the sealed pilot 11. An ODS senses when the atmospheric oxygen available for combustion is depleted and then shuts off the supply of gas to an unvented gas heater. A thermocouple 12 is conventionally installed as a part of an oxygen depletion safety device.

The thermocouple 12 is positioned to be heated by the gas flame in the pilot. The heated thermocouple generates a low voltage electric current (approximately 24–32 open circuit millivolts) and is connected to a small horseshoe electromagnet (not shown) that is magnetically engaged with a valve 20 in the gas supply line 22. While the thermocouple 12 is heated by the pilot flame the thermocouple continues to generate sufficient voltage (approximately 14–22 closed circuit millivolts) to energize the electromagnet to hold the valve 20 open. As the pilot flame becomes unstable, the energy generated by the thermocouple 12 decreases and with it the magnetic force holding the valve open. Eventually, in approximately half a minute, the magnet force becomes so weak that it can no longer hold the valve open against the tension of the safety spring. The valve 20 therefore closes, shutting off the flow of gas to both the pilot 11 and the unvented main gas burner 24.

A relatively small variation in the rate of oxygen supplied to the combustion process brings a considerable reduction to the size of the flame. It is for this reason that the present invention utilizes a thermocouple 12 in addition to a thermopile 13. The thermocouple 12 (or 12A) provides thermoelectric safety for the gas control valve 20. The thermopile 13 provides power for the operation of the solenoid valve 26; which may be controlled by a remote switching device (thermostat 28) or by a manual switch(not shown). Restated, the function of the thermocouple 12 is safety and the function of the thermopile 13 is operation. The thermopile 13 does not provide Oxygen Depletion Shutoff.

According to the present invention, the thermopile 13 is preferably mounted for use in virtual engagement with the pilot 11, well within the half inch exclusion zone of Eavenson Patent No. 5,397,233. Eavenson describes the half inch exclusion zone as being necessary because:

"It has been found that by using a large 250 to 750 millivolts generator [thermopile] with a diameter greater than 0.25 inch, substantial heat is retained on the generator barrel while the pilot flame is on. If the barrel is too close to the pilot opening, the hot barrel will cause a flame to continue to form around the barrel after the oxygen depletion sensor extinguishes the pilot flame, thereby causing the pilot generator to continue to operate, i.e. supply voltage to valve 24 [gas valve]. Thus the low oxygen safety feature of the system would fail because the main gas, as well as the pilot gas, would not be turned off in a low oxygen situation. Eavenson Patent No. 5,397,233, column 3, line 60 to column 4, line 4.

The size of the thermopile used in the present invention has the same range of voltage (250 to 750 millivolts) as described in the Eavenson patent in order to effectively operate the main burner flame for the desired room temperature. According to the present invention, though, by using the thermocouple 12, the thermopile 13 can be placed within a fraction of an inch of the pilot without sacrificing "the low oxygen safety feature of the system", as Eavenson puts it.

If the pilot 11 goes out while using the safety system of this invention, the thermocouple 12 will quickly cool and deenergize to the point of releasing the electromagnetic valve cover and cutting off the gas flow to the pilot 11 and to the main burner 24 in the unvented gas heater. Therefore, there is no danger of a flame surrounding the barrel of the thermopile 13 after the ODS has sensed a deficiency of oxygen, even though the thermopile 13 is less than a half inch from the pilot 11.

Figure 2:
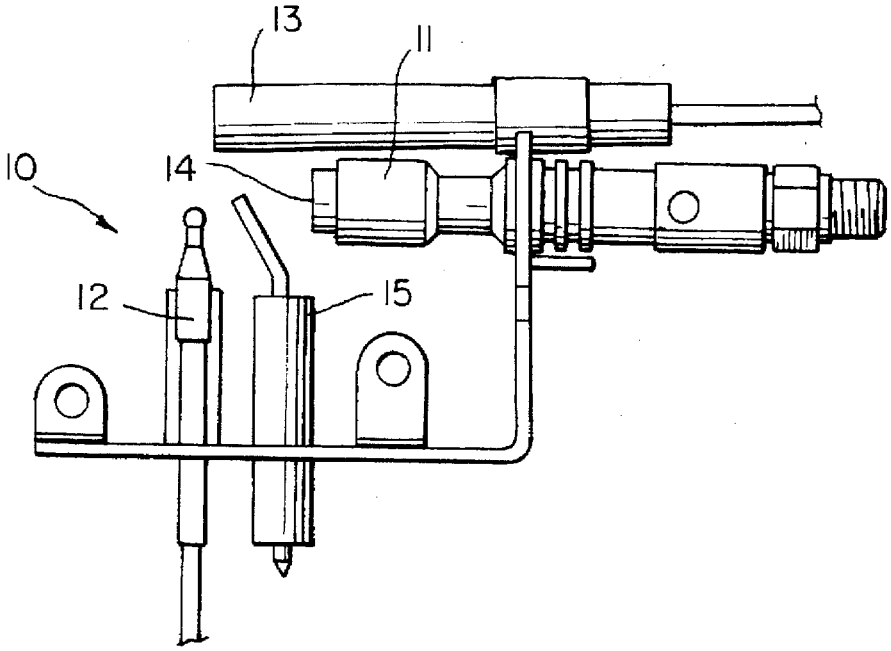
FIG. 2 is a somewhat schematic view of the control apparatus for use with natural gas.
Figure 3:
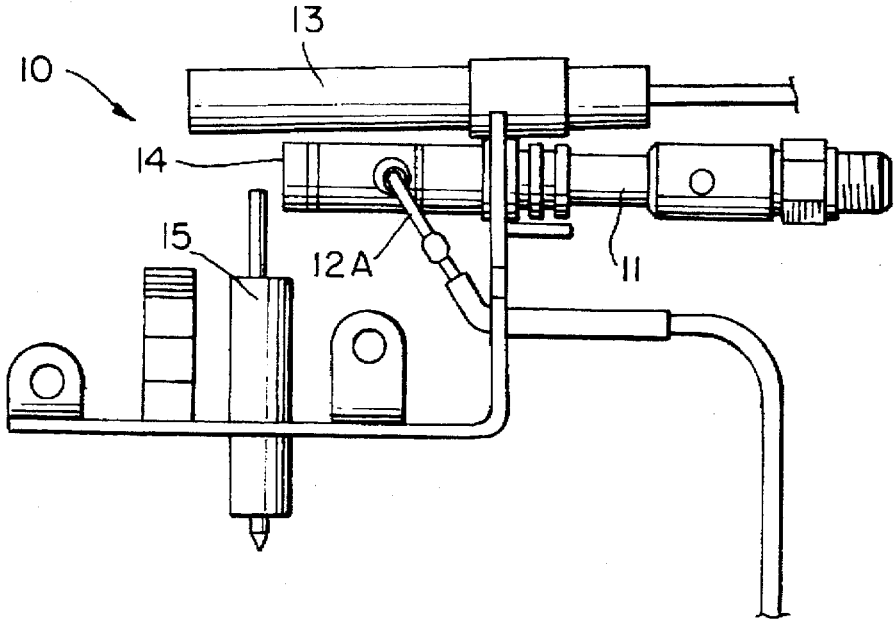
FIG. 3 is a somewhat schematic view of the control apparatus for use with liquified petroleum gas.

FIGS. 1 and 2 show the thermocouple 12 spaced from the open end 14 of the pilot 11, beyond the ignitor 15, for use with natural gas. When the safety system of this invention is used with liquified petroleum gas, the thermocouple 12A is welded or otherwise fastened to the barrel of the pilot 11, as shown in FIG. 3.

There is thus provided a novel safety system for use with unvented gas heating appliances that supplies the electrical energy for operation of a thermostat to control the temperature of the heated area and retains the established safety of the thermocouple to shut off the flow of gas to the main burner of an unvented gas heater if the pilot flame goes out.

Although specific terms have been used in describing the invention, they have been used in a generic and descriptive sense only and not for the purpose of limitation, the scope of the invention being defined in the following claims to invention.

We claim:

1. An apparatus for controlling the temperature of an area heated by an unvented gas fired appliance, the unvented gas fired appliance having a main burner and a pilot having an opening where flame is produced by gas through a gas supply line having a first electromagnetic gas valve that is operable to control the flow of gas to the main burner and to the pilot and a thermocouple positioned to be heated by the pilot flame and operably connected to the first electromagnetic gas valve, wherein the improvement comprises a thermopile positioned to be heated by the pilot flame, a second electromagnetic gas valve that is operable to control the flow of gas to only the main burner, and a thermostat operatively connected to the thermopile and to the second electromagnetic gas valve, whereby the temperature of the area is controlled by setting the thermostat to the desired temperature.

2. The invention of claim 1 wherein the thermocouple generates an electric current in the range of 24–32 open circuit millivolts and while the thermocouple is heated by the pilot flame it generates voltage in the range of 14–22 millivolts to hold open the first electromagnetic gas valve.

3. The invention of claim 1 wherein the thermopile generates an electric current in the range of 250 to 750 millivolts.

4. The invention of claim 1 wherein the thermocouple is fastened to the pilot.

5. The invention of claim 3 wherein the thermopile is placed within a fraction of an inch of the pilot.

6. Apparatus for controlling the temperature of an area heated by an unvented gas fired appliance, the apparatus comprising a main burner and a pilot, a first electromagnetic gas valve, said first electromagnetic gas valve controlling the flow of gas to the main burner and to the pilot, said pilot having an opening where flame is produced, a thermocouple positioned to be heated by the gas flame in the pilot to generate a low voltage electric current, said thermocouple being operatively connected to the first electromagnetic gas valve to normally open said first gas valve while the pilot flame heats the thermocouple and to close the first gas valve when the pilot flame is extinguished and the thermocouple cools, a second electromagnetic gas valve, said second electromagnetic gas valve controlling the flow of gas to only the main burner, a thermopile positioned to be heated by the gas flame in the pilot to generate a low voltage current that is higher than the voltage generated by the thermocouple, a thermostat operatively connected to the thermopile, and circuit means for operatively connecting the thermostat and the thermopile to the second electromagnetic gas valve, whereby the thermocouple normally functions to open the first electromagnetic gas valve to allow the flow of gas to the pilot and to the main burner but shuts off the gas to the pilot and to the main burner if the pilot is extinguished, the thermopile normally functions to supply electrical energy for operation of the thermostat, and the thermostat controls the flow of gas to the main burner depending on the desired temperature setting of the thermostat.

* * * * *